US008348107B2

(12) United States Patent
Succar et al.

(10) Patent No.: US 8,348,107 B2
(45) Date of Patent: Jan. 8, 2013

(54) FOOD DISPENSING APPARATUS

(75) Inventors: Jorge Succar, Yorba Linda, CA (US); David C. Sorrick, Omaha, NE (US); Mario Mikula, Mission Viego, CA (US); Lorenzo Brescia, Luxembourg (LU)

(73) Assignee: ConAgra Foods RDM, Inc.

( * ) Notice: Subject to any disclaimer, the term of this patent is extended or adjusted under 35 U.S.C. 154(b) by 438 days.

(21) Appl. No.: 12/527,896

(22) PCT Filed: Feb. 19, 2008

(86) PCT No.: PCT/US2008/054265

§ 371 (c)(1), (2), (4) Date: Dec. 4, 2009

(87) PCT Pub. No.: WO2008/103649

PCT Pub. Date: Aug. 28, 2008

(65) Prior Publication Data

US 2010/0075001 A1 Mar. 25, 2010

Related U.S. Application Data

(60) Provisional application No. 60/902,187, filed on Feb. 20, 2007, provisional application No. 60/902,188, filed on Feb. 20, 2007, provisional application No. 60/902,189, filed on Feb. 20, 2007.

(51) Int. Cl.
*B67D 7/72* (2010.01)
*B67D 7/58* (2010.01)

(52) U.S. Cl. ..... 222/401; 222/95; 222/209; 222/373; 222/380; 222/383.1; 222/386.5; 222/389

(58) Field of Classification Search ..... 222/95, 222/105, 209, 373, 380, 383.1, 386.5, 401, 222/94, 96, 206, 212, 213, 389, 394, 372
See application file for complete search history.

(56) References Cited

U.S. PATENT DOCUMENTS

| | | | | |
|---|---|---|---|---|
| 2,333,451 | A * | 11/1943 | Sussman et al. | 401/145 |
| 4,147,278 | A | 4/1979 | Uhlig | |
| 5,012,956 | A | 5/1991 | Stoody | |
| 5,031,785 | A | 7/1991 | Lemme | |
| 5,108,007 | A | 4/1992 | Smith et al. | |
| 5,273,191 | A | 12/1993 | Meshberg | |
| 5,318,204 | A | 6/1994 | Davis et al. | |

(Continued)

FOREIGN PATENT DOCUMENTS

| | | |
|---|---|---|
| EP | 591164 | 1/1997 |

(Continued)

OTHER PUBLICATIONS

International Search Report for PCT Application No. PCT/US2008/054265dated Sep. 16, 2008 (Form PCT/ISA/210.).

*Primary Examiner* — J. Casimer Jacyna
(74) *Attorney, Agent, or Firm* — Advent; Ryan T. Grace

(57) ABSTRACT

A food dispensing apparatus comprises a first shell, at least one second shell disposed within the first shell, a nozzle coupled to the first shell and the at least one second shell, and a check valve disposed in the nozzle and coupled to the at least one second shell. The at least one second shell is suitable for containing a food component. The food dispensing apparatus is suitable for preventing air from entering the at least one second shell.

23 Claims, 16 Drawing Sheets

U.S. PATENT DOCUMENTS

| | | | | |
|---|---|---|---|---|
| 5,332,121 | A | 7/1994 | Schmidt | |
| 5,529,213 | A | 6/1996 | Mack et al. | |
| 6,349,860 | B1 | 2/2002 | McMahon et al. | |
| 6,672,487 | B1 | 1/2004 | Lohrman | |
| 6,786,363 | B1 | 9/2004 | Lohrman | |
| 6,880,736 | B1 | 4/2005 | Gnepper | |
| 7,096,893 | B2 | 8/2006 | Vilalta et al. | |
| 7,131,558 | B2 * | 11/2006 | de la Guardia | 222/209 |
| 2004/0040618 | A1 | 3/2004 | Vilalta et al. | |
| 2005/0061813 | A1 | 3/2005 | Vilalta et al. | |
| 2005/0074342 | A1 | 4/2005 | Lemme et al. | |
| 2006/0008559 | A1 | 1/2006 | Hillios et al. | |
| 2006/0065132 | A1 | 3/2006 | Jongen et al. | |

FOREIGN PATENT DOCUMENTS

| | | |
|---|---|---|
| WO | WO9112185 | 8/1991 |
| WO | WO2005035091 | 4/2005 |
| WO | WO2006063000 | 6/2006 |

* cited by examiner

FOOD DISPENSING APPARATUS

This application is being filed on 20 Aug. 2009, as a US National Stage of PCT International Patent application No. PCT/US2008/054265, filed 19 Feb. 2008 in the name of ConAgra Foods RDM, Inc., a U.S. national corporation, applicant for the designation of all countries except the US, and Jorge Succar, David C. Sorrick and Mario Mikula, citizens of the U.S. and Lorenzo Brescia, citizen of Ecuador and Italy, applicants for the designation of the US only, and claims priority to U.S. Provisional Patent Application Serial Nos. 60/902,188, 60/902,187 and 60/902,189, all filed Feb. 20, 2007 and all applications are hereby incorporated by reference in their entirety.

TECHNICAL FIELD

The disclosure generally relates to the field of food containers, and more particularly to an apparatus for dispensing a food component.

BACKGROUND

A wide range of food components are frequently dispensed from bottles or other containers, including ketchup, barbeque sauce, peanut butter, sour cream, salad dressing, mayonnaise, and mustard. However, food components stored in bottles can undergo serum separation, or syneresis. Additionally, highly viscous food components are not easily dispensed from bottles or containers.

Serum separation is when a watery liquid, known as serum, separates from the food component and rests in empty air space surrounding the food component. Serum separation is a gravity driven recurring phenomenon that can develop every time the container is restored to a rest position after dispensing a food component. When the container is inverted, the serum can reach the discharge point before the food component. Serum separation is common in many tomato-based products, such as ketchup and tomato sauce. Serum separation is common in other foods as well, such as mustard, barbeque sauce, and sour cream. Consumers can view the appearance of serum unfavorably.

Typical thickening agents, such as gums and hydrocolloids, can reduce serum separation and increase serum viscosity in products like ketchup. However, the Food and Drug Administration mandates in its standard of identity that if certain ingredients, such as thickening agents, are added to ketchup, the food component can no longer be labeled as ketchup.

Further, highly viscous food components, such as peanut butter, do not flow without added force and may require an undesirable amount of consumer effort for consumption. A squeeze bottle is not as effective for a food component, such as peanut butter, mayonnaise, or jams and jellies, because of this high viscosity and non-Newtonian properties, which tend to disfavor natural and effective product flow.

Also, one food component is generally dispensed from one container. When multiple toppings are desired for application on a food component, such as the case with condiments, it is necessary to utilize multiple topping containers for dispensing the toppings. For example, ketchup, mustard, and relish may be desired as a topping for a food component. A consumer is required to use a separate container of ketchup, a separate container of mustard, and a separate container of relish when multiple condiments are desired for a food component.

Further, these typical food component containers are generally disposable or intended for single use. Single use or disposable containers may require extra cost and create waste.

SUMMARY

The disclosure describes a food dispensing apparatus and food product.

The food dispensing apparatus can comprise a first shell, at least one second shell disposed within the first shell, a nozzle coupled to the first shell and the at least one second shell, and a check valve disposed in the nozzle and coupled to the at least one second shell. The at least one second shell is suitable for containing a food component. The food dispensing apparatus is suitable for preventing air from entering the at least one second shell.

The food dispensing apparatus comprises a first shell, at least one second shell disposed within the first shell, a nozzle coupled to the first shell and the at least one second shell, and an air pump assembly coupled to the first shell. The air pump assembly is suitable for pumping air into a chamber between the first shell and the at least one second shell. The air pumped into the chamber applies pressure to the food component contained in the at least one second shell for dispensing the food component through the nozzle.

The food dispensing apparatus can comprise a first shell, at least two second shells disposed within the first shell, a nozzle coupled to the first shell and the at least two second shells, and a valve selector assembly, the valve selector assembly located in the nozzle. Each of the at least two second shells is suitable for separately containing a food component. The valve selector assembly is suitable for selecting the food component from at least one of the at least two second shells.

The food product comprises a food dispensing apparatus, the food dispensing apparatus comprising, a first shell, at least one second shell disposed within the first shell, a nozzle coupled to the first shell and the at least one second shell, and a check valve disposed in the nozzle coupled to the at least one second shell; and a food component disposed in the at least one second shell of the food dispensing apparatus, the food component comprising any liquid or semi-solid food component capable of undergoing serum separation The food dispensing apparatus is suitable for preventing air from entering the at least one second shell. The food dispensing apparatus prevents serum separation.

It is to be understood that both the foregoing general description and the following detailed description are exemplary and explanatory only and are not necessarily restrictive of the claims. The accompanying drawings, which are incorporated in and constitute a part of the specification, illustrate examples and together with the general description, serve to explain the principles of the disclosure.

BRIEF DESCRIPTION OF THE DRAWINGS

The disclosure can be better understood by those skilled in the art by reference to the accompanying figures in which.

DETAILED DESCRIPTION

Figure 1:
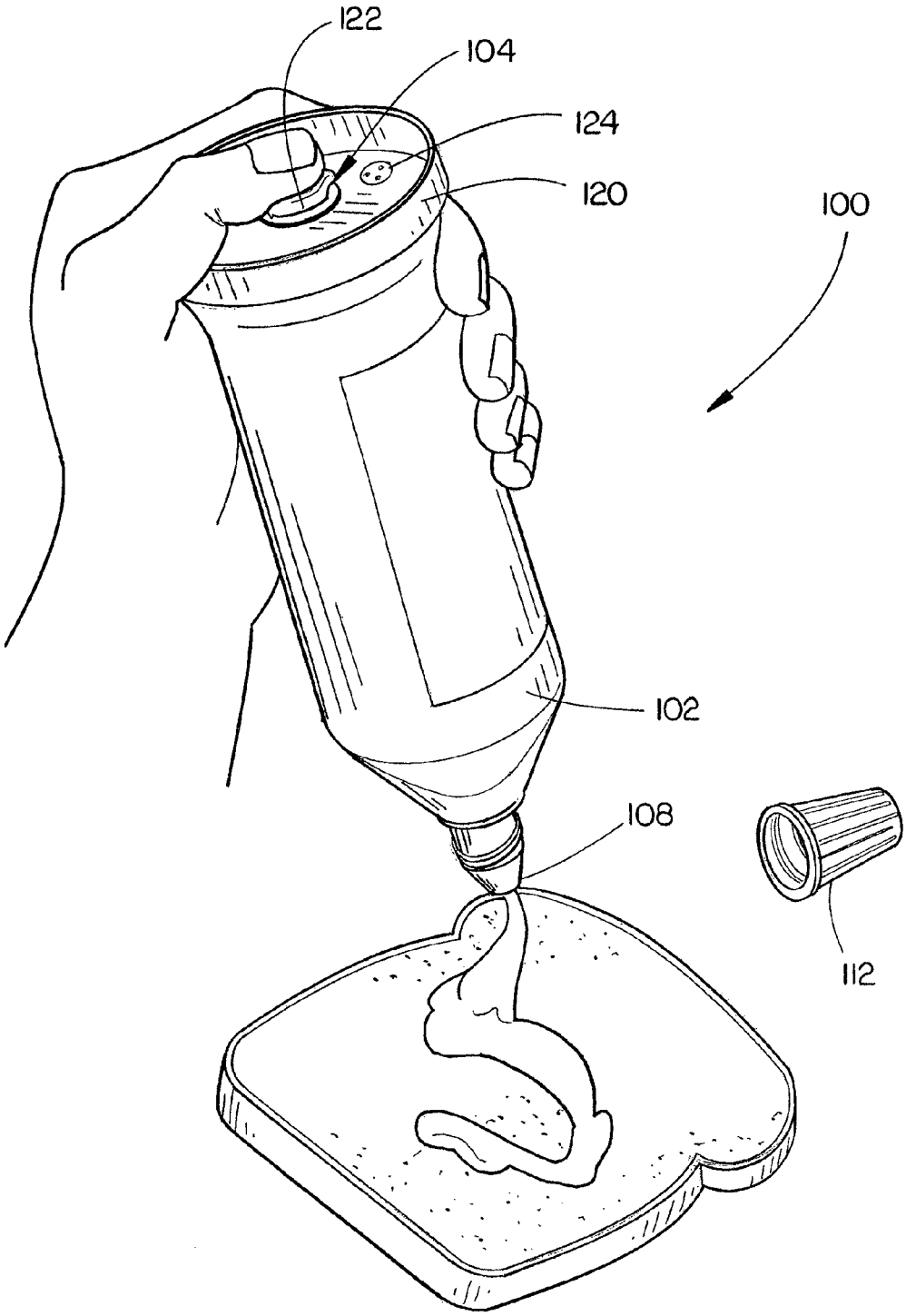
FIG. 1 is an isometric view illustrating a food dispensing apparatus with a manual air pump.

Referring generally to FIGS. 1 through 18, a food dispensing apparatus 100 is shown. The food dispensing apparatus 100 comprises an outer shell 102, at least one inner shell 110, and a nozzle 108. The outer shell 102 can be referred to as a first shell 102, and the inner shell 110 can be referred to as a second shell 110.

Figure 6:
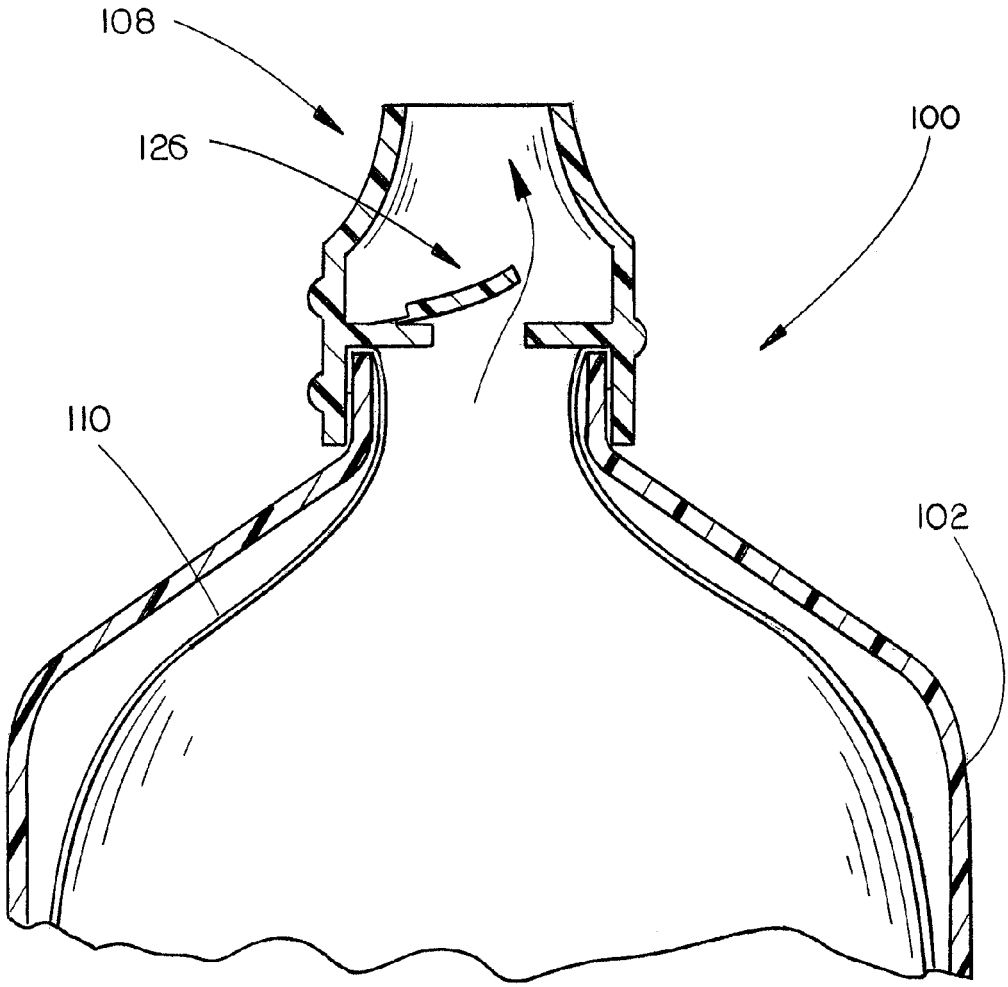
FIG. 6 is a partial cross-sectional view illustrating a nozzle and check valve for dispensing food from a food dispensing apparatus.
Figure 7:
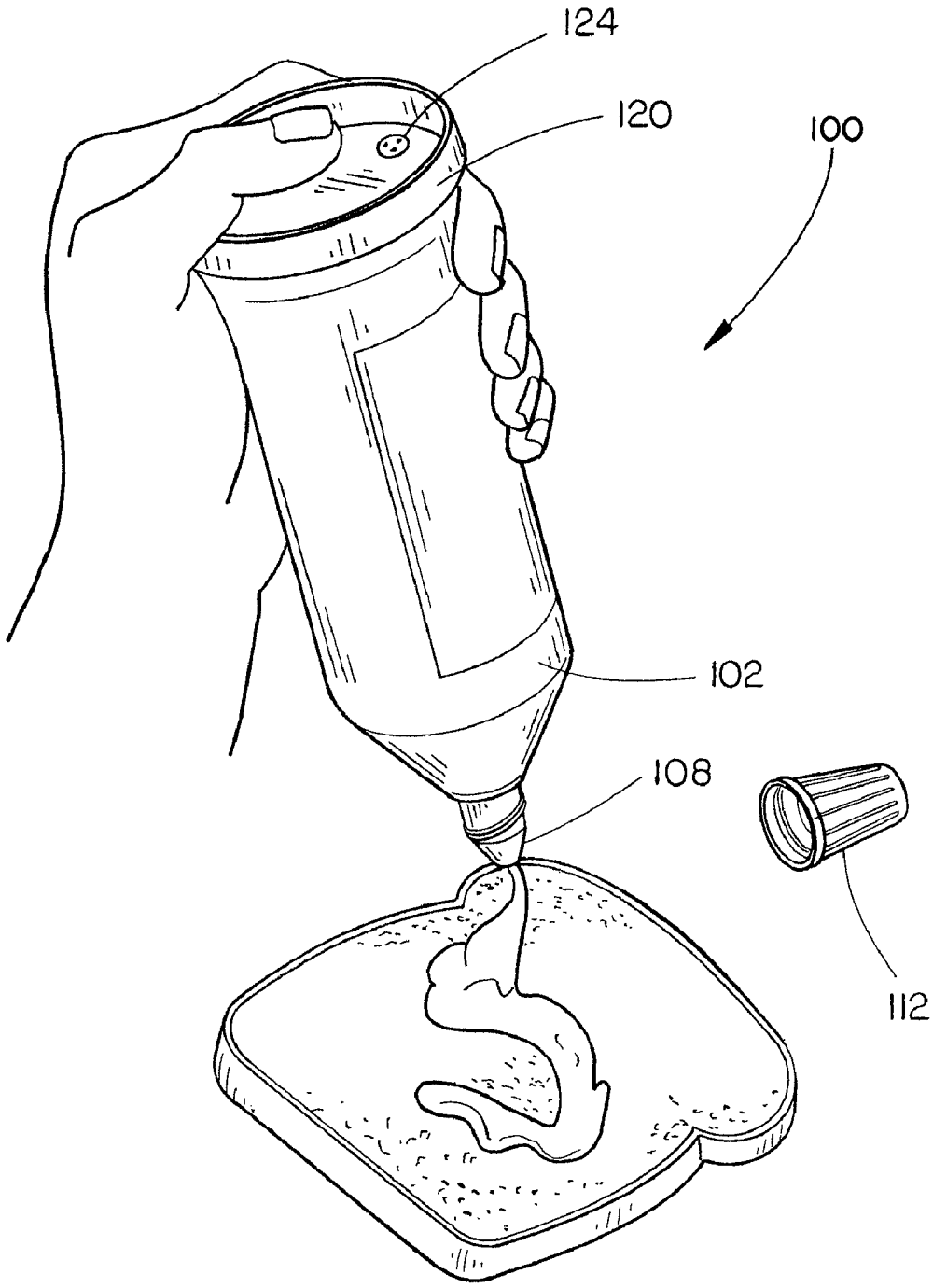
FIG. 7 is an isometric view illustrating a food dispensing apparatus, wherein the food dispensing apparatus is depicted dispensing a food component.
Figure 8:
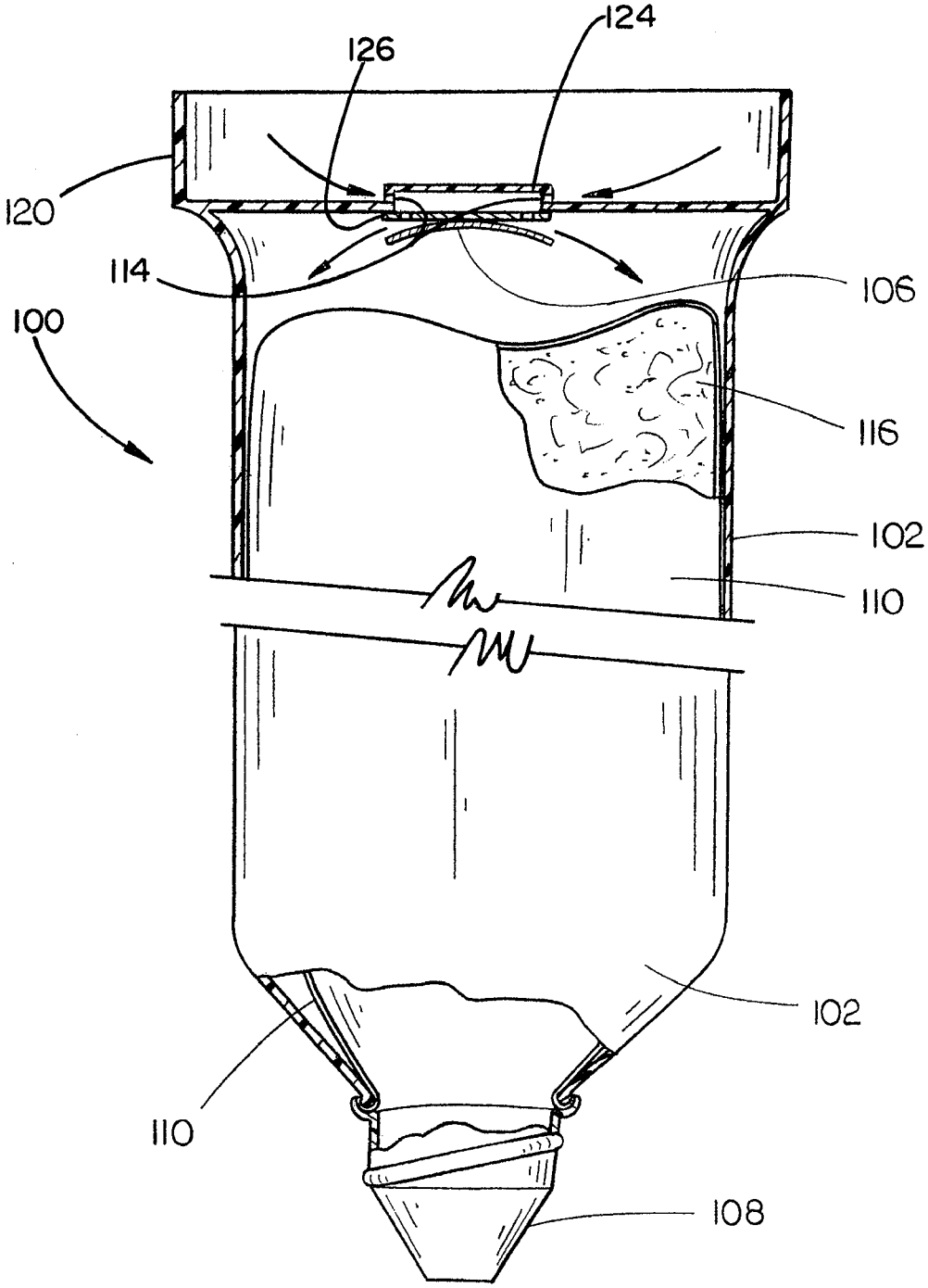
FIG. 8 is a partial cross-sectional side view of the food dispensing apparatus illustrated in FIG. 7, wherein a portion of the outer shell and inner shell has been cut away to illustrate the inner shell and food component.
Figure 9:
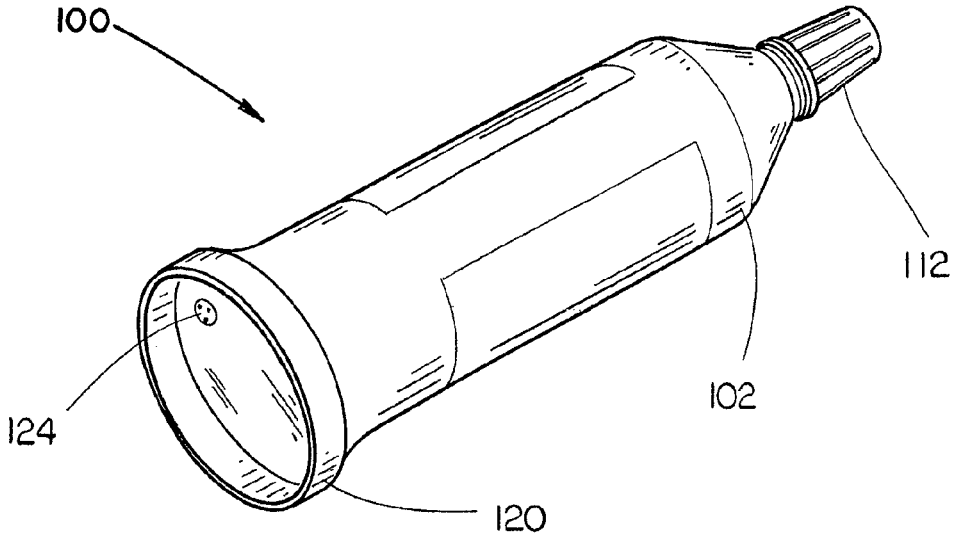
FIG. 9 is an isometric view of the food dispensing apparatus illustrated in FIG. 7.
Figure 10:
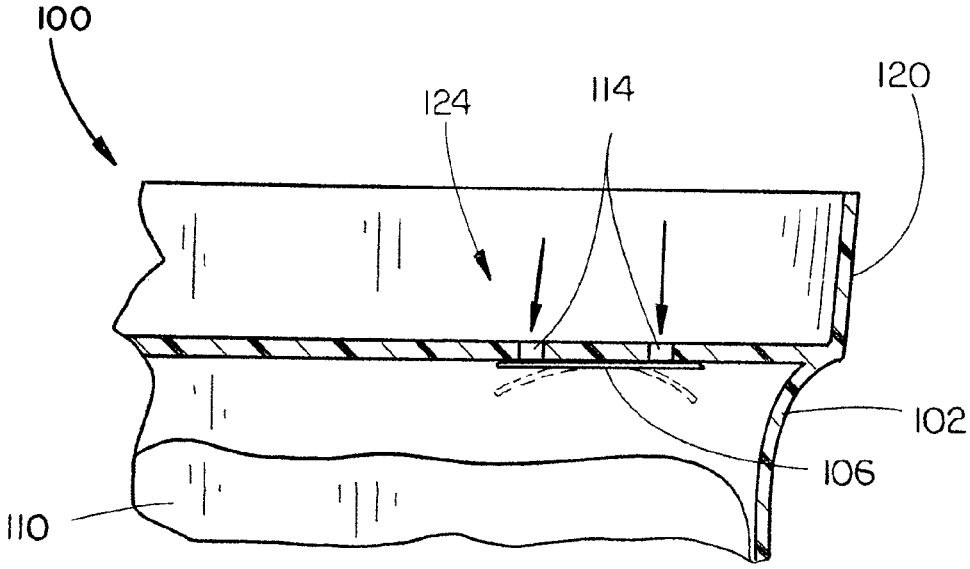
FIG. 10 is partial cross-sectional side view illustrating an air vent.
Figure 11B:
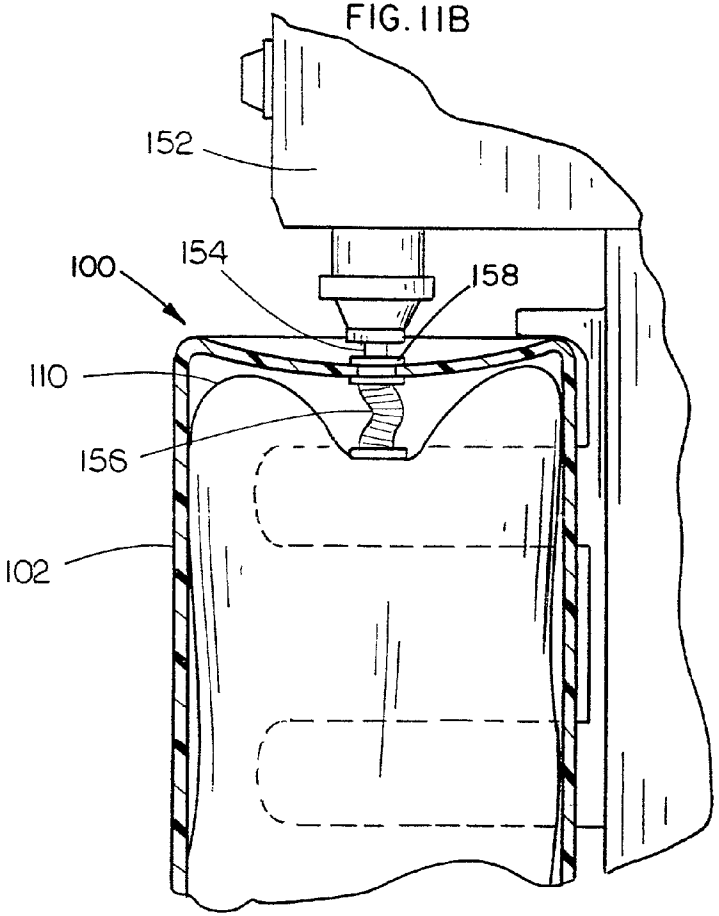
FIG. 11B is a is a partial side elevational view illustrating a food filling apparatus, wherein a food filling apparatus is inserted into the food dispensing apparatus.
Figure 11A:
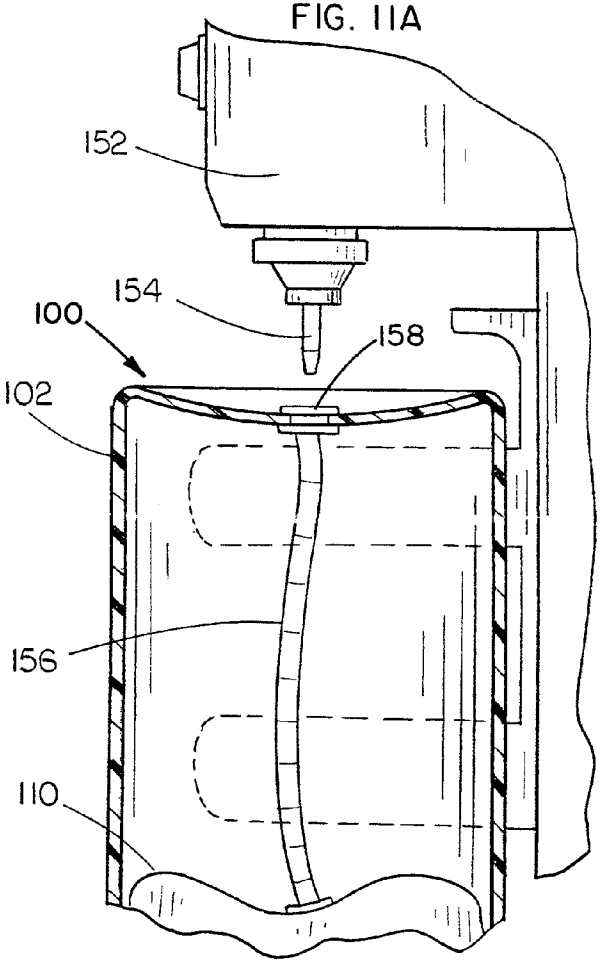
FIG. 11A is a partial side elevational view illustrating a food filling apparatus, wherein a food dispensing apparatus is in position for filling.
Figure 12:
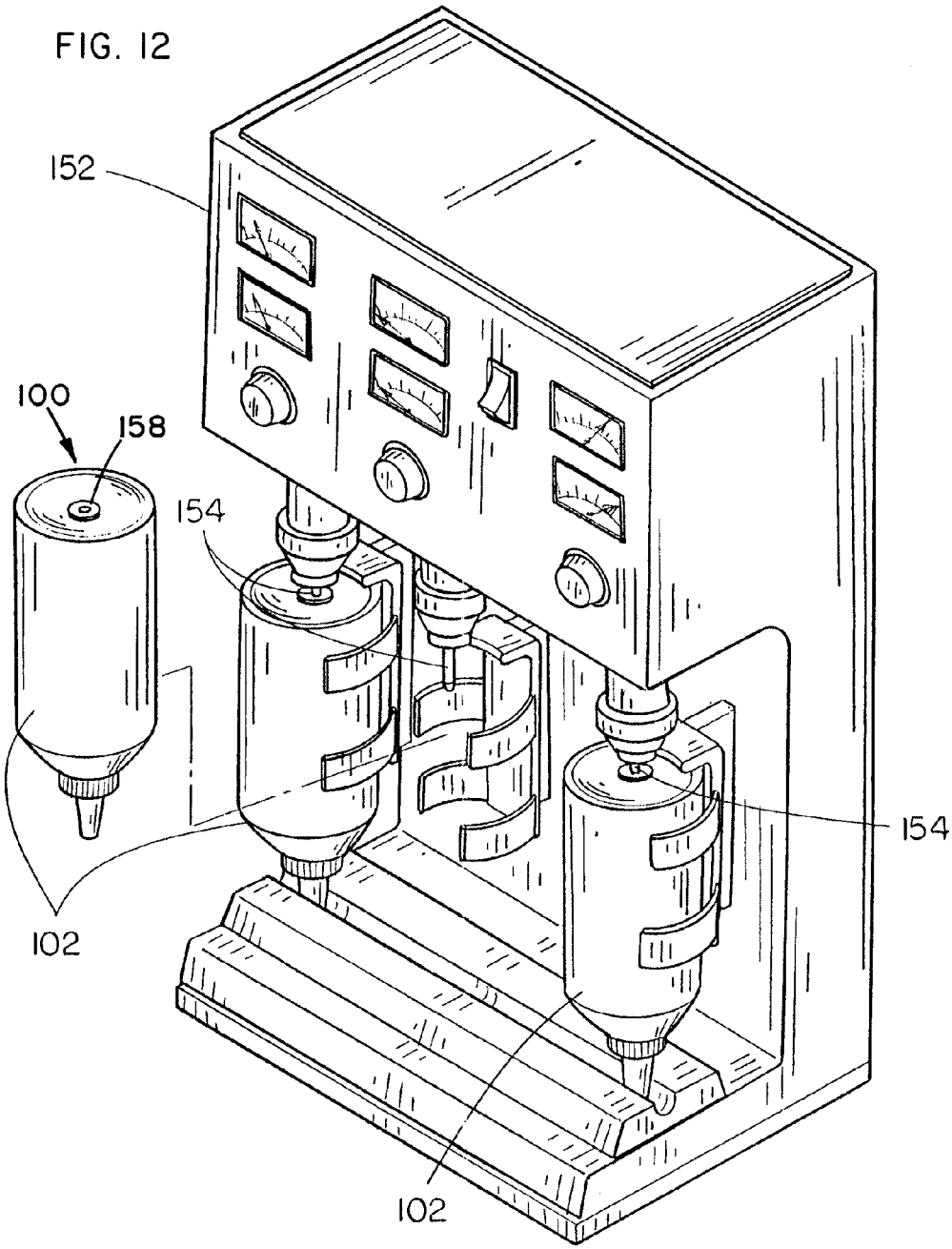
FIG. 12 is an isometric view illustrating a food filling apparatus, wherein multiple food dispensing apparatuses are in position for filling.

The nozzle 108 can comprise a valve, such as a check valve 126, as illustrated in FIG. 6. A check valve 126 in combination with the at least one inner shell 110, outer shell 102 and nozzle 108 prevent serum separation in the food component 116 by preventing air or other materials from entering the second shell 110 thereby eliminating any empty space, which is necessary for the formation of the serum.

The food dispensing apparatus 100 can comprise an air pump assembly 104. The air pump assembly 104 allows food components 116 with high viscosities, such as peanut butter, to be dispensed with minimal force from the food dispensing apparatus 100.

Figure 15:
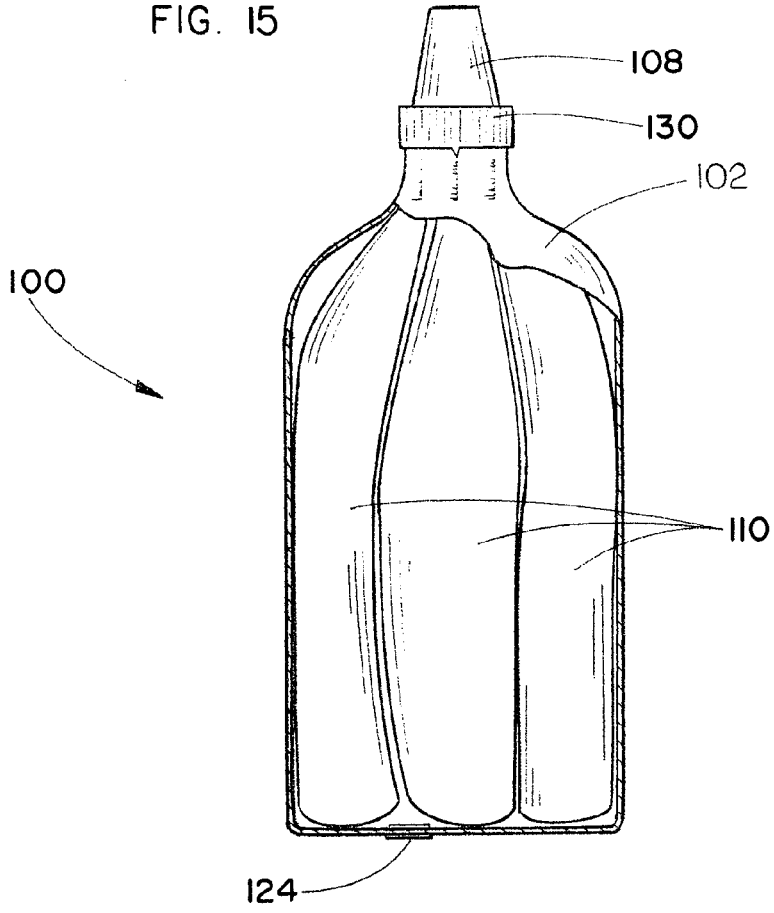
FIG. 15 is a partial isometric view illustrating a food dispensing apparatus, wherein a portion of the outer shell has been cut-away to show multiple inner shells.
Figure 16:
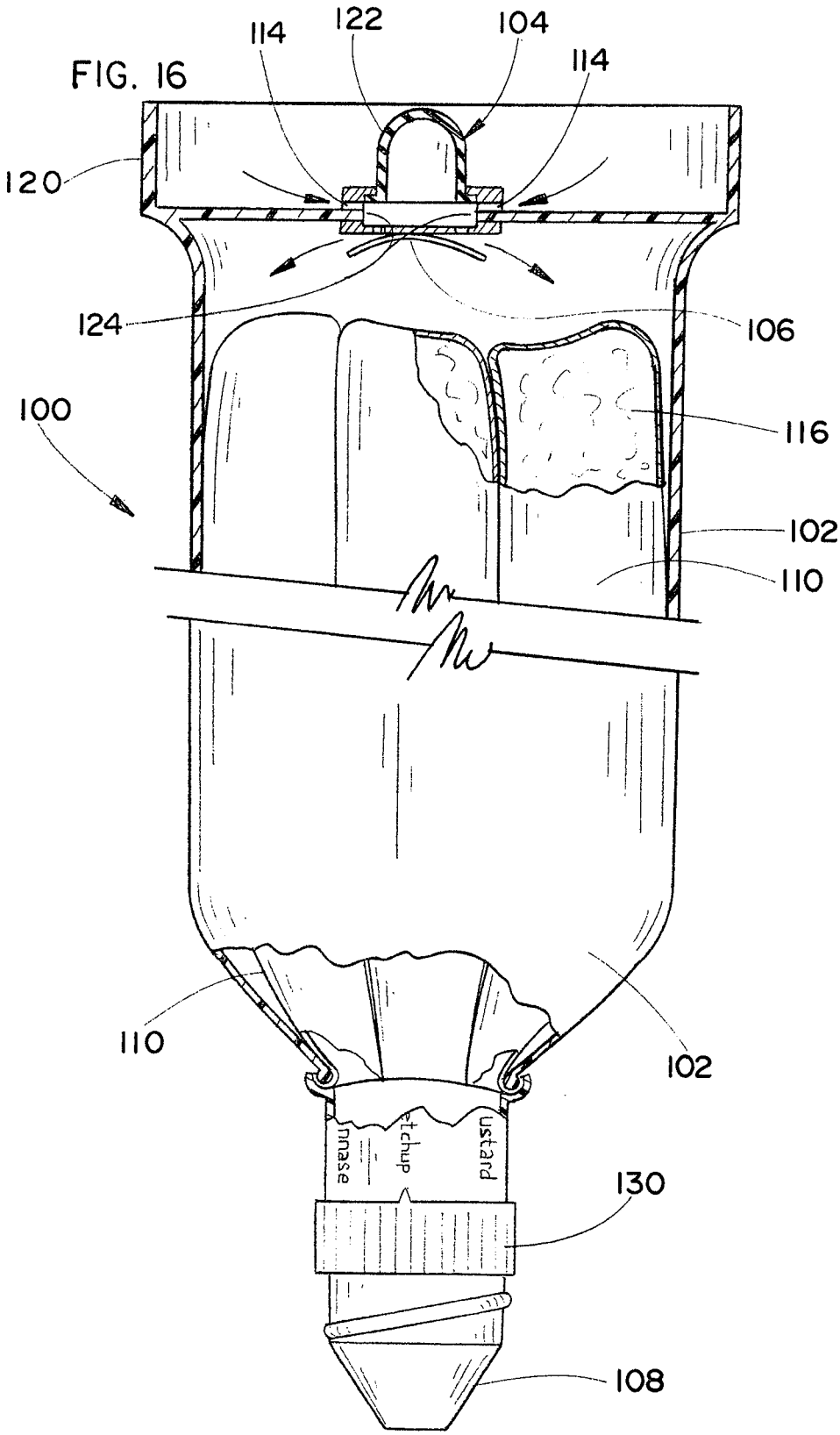
FIG. 16 is a cross-sectional side view of the food dispensing apparatus comprising a selecting valve, wherein a portion of the outer shell and inner shell has been cut away to illustrate multiple inner shells containing different food components and an air pump assembly.
Figure 17:
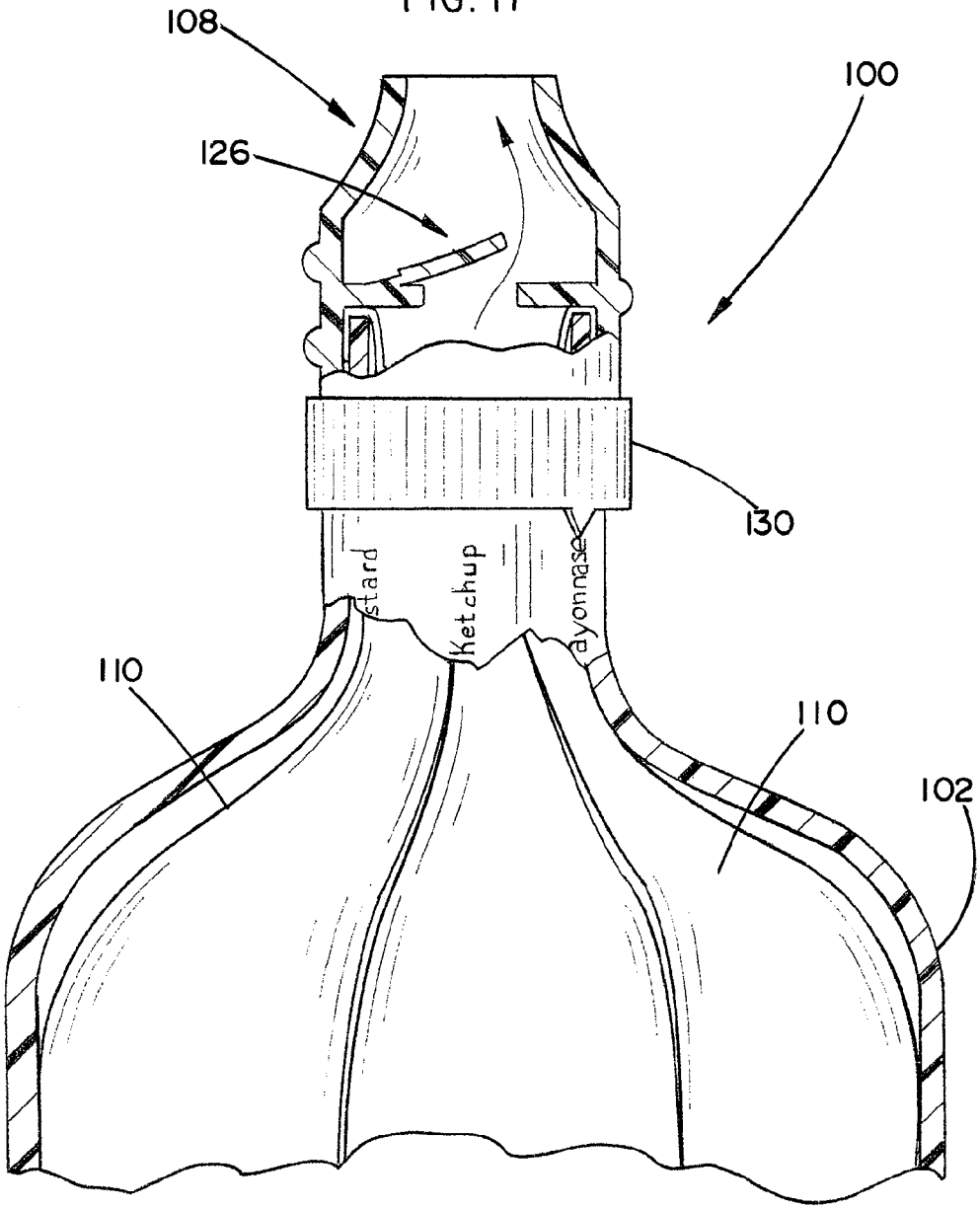
FIG. 17 is a partial cross-sectional side view illustrating a food dispensing apparatus comprising a dispensing nozzle, a selecting valve, and a check valve.

The food dispensing apparatus 100 can comprise multiple inner shells 110 suitable for separately containing multiple and/or different food components 116, as illustrated in FIG. 15.

A food product comprises the food dispensing apparatus 100 and a food component 116. The food component 116 can comprise any liquid or semi-solid food component, such as condiments, including ketchup, relish, mustard, and mayonnaise; sauces, including barbeque sauce, tomato sauce, cocktail sauce, pizza sauce, and hot sauce; peanut butter; batter; mashed potatoes; cheese; cheese spreads; whip cream; honey; salad dressing; spreadable butter; and sour cream. This list is not restrictive. It is contemplated that any liquid or semi-solid food component can be utilized without departing from the scope and intent of the disclosure. The food product can comprise a food component that is capable of serum separation, such as ketchup, tomato paste, tomato sauce, pizza sauce, mustard, and sour cream. This list is not restrictive. It is appreciated that any liquid or semi-solid food component 116 capable of serum separation may be utilized without departing from the scope and intent of the disclosure.

With regard to traditional container designs, serum separation can occur in a full, unopened bottle or in a partially full bottle during regular use. Phase separation is typically minimal or non-existent on a horizontal surface, such as the one found in the neck of an unopened bottle. Many food components 116, for example ketchup, have a visco-elastic structure that develops after time due to entanglement and agglomeration of macromolecules and particles. As a result of these interactions, the average floc size of the food component 116 can increase at rest. The increase in floc size results in the formation of a network structure with an infinite viscosity at a critical shear stress, referred to as yield stress. Equilibrium of the network structure can be reached between approximately twenty-four and seventy-two hours. Serum separation generally occurs subsequent to disturbance of the food component, and the occasional minor amount of free serum found in the neck of an unopened ketchup bottle is often the result of ketchup that splashed around the neck during packaging and transportation or condensation of water vapors.

Upon pouring, the ketchup equilibrium is disturbed due to exceeding the ketchup yield stress. It is necessary to exceed the yield stress for the ketchup to flow from the bottle. Once the equilibrium is disturbed and the network structure is disturbed, phase separation can occur rapidly, often less than 30 minutes after the first use of a bottle. When the bottle is returned to rest, the network structure stability recovers rapidly preventing the formation of an even, horizontal surface in the partially full bottle. Under the force of gravity, serum separation occurs, and cavities and depressions on the uneven surface rapidly fill with a substantially clear and sometimes red-colored liquid or serum. Further, any created air bubble will rapidly fill with serum. A similar serum separation sequence occurs in other food components 116, such as mustard, tomato paste, and sour cream. This list is not restrictive. Serum separation in a food component 116 is reduced by the food dispensing apparatus 100 by eliminating air pockets and headspace thereby preventing the formation of a space, which is necessary for serum separation to occur.

Further, with regard to traditional container designs, highly viscous food components, such as mayonnaise, peanut butter, jams, and jellies can require an undesirable amount of consumer force to dispense the food component for consumption. The food dispensing apparatus 100 can comprise an air pump assembly 104. The air pump assembly 104 can substantially reduce the amount of force necessary to dispense a highly viscous product from a container. The air pump assembly 104 can reduce the amount of force necessary for dispensing the food component to 0. A consumer may not have to squeeze the food dispensing apparatus 100 to dispense the food component 116 from the food dispensing apparatus 100. The consumer may merely have to utilize the air pump assembly 104, such as depressing the bulb reservoir 122 of the air pump assembly 104. Therefore, the air pump assembly 104 allows a food component, such as peanut butter, to be easily dispersed from a container. Additionally, highly viscous products, such as peanut butter, can have similar phase separation, such as oil separation from the peanut butter after use. The food dispensing apparatus 100 can also prevent this type of phase separation by eliminating the space necessary for this separation to take place.

Additionally, traditional containers do not contain and dispense multiple food components. Typically, multiple containers are necessary when applying multiple food components 116. The food dispensing apparatus 100 can also dispense one food component. However, the food dispensing apparatus 100 can also provide a single disposable and/or refillable container for dispensing at least two different food components. Further, the food dispensing apparatus 100 may hold a more desirable amount of the multiple and/or different food components 116, such as condiments. Many people do not use the amount of a condiment present in the standard size bottles sold in stores, and the condiment may spoil before it is consumed.

The food dispensing apparatus 100 comprises an outer shell 102 for containing the inner shell 110 and a food component 116. The outer shell 102 can include any appropriate material including rigid, semi-rigid, and flexible materials. The material can include polyethylene, polyvinyl chloride, polypropylene, polyethylene terephthalate, polystyrene, metals, and/or other polymers. This list not restrictive. It is contemplated that other materials suitable for food component apparatuses can be utilized without departing from the scope and intent of the disclosure. The outer shell 102 can include a base 120 for stabilizing the food dispensing apparatus 100. The base 120 can be any suitable design for supporting the food dispensing apparatus 100. The base 120 can support the food dispensing apparatus 100 in any suitable position. The base 120 can support the food dispensing apparatus 100 so the nozzle 108 is as far from the ground as possible, the nozzle 108 is adjacent to the ground, or the nozzle 108 is perpendicular with ground. The base 120 can be coupled to the nozzle 108. This list is not restrictive. It is appreciated that any suitable design for supporting a food dispensing apparatus 100 can be utilized without departing form the scope and intent of the disclosure. Further, the food dispensing apparatus 100 may not comprise a base 120.

Figure 2:
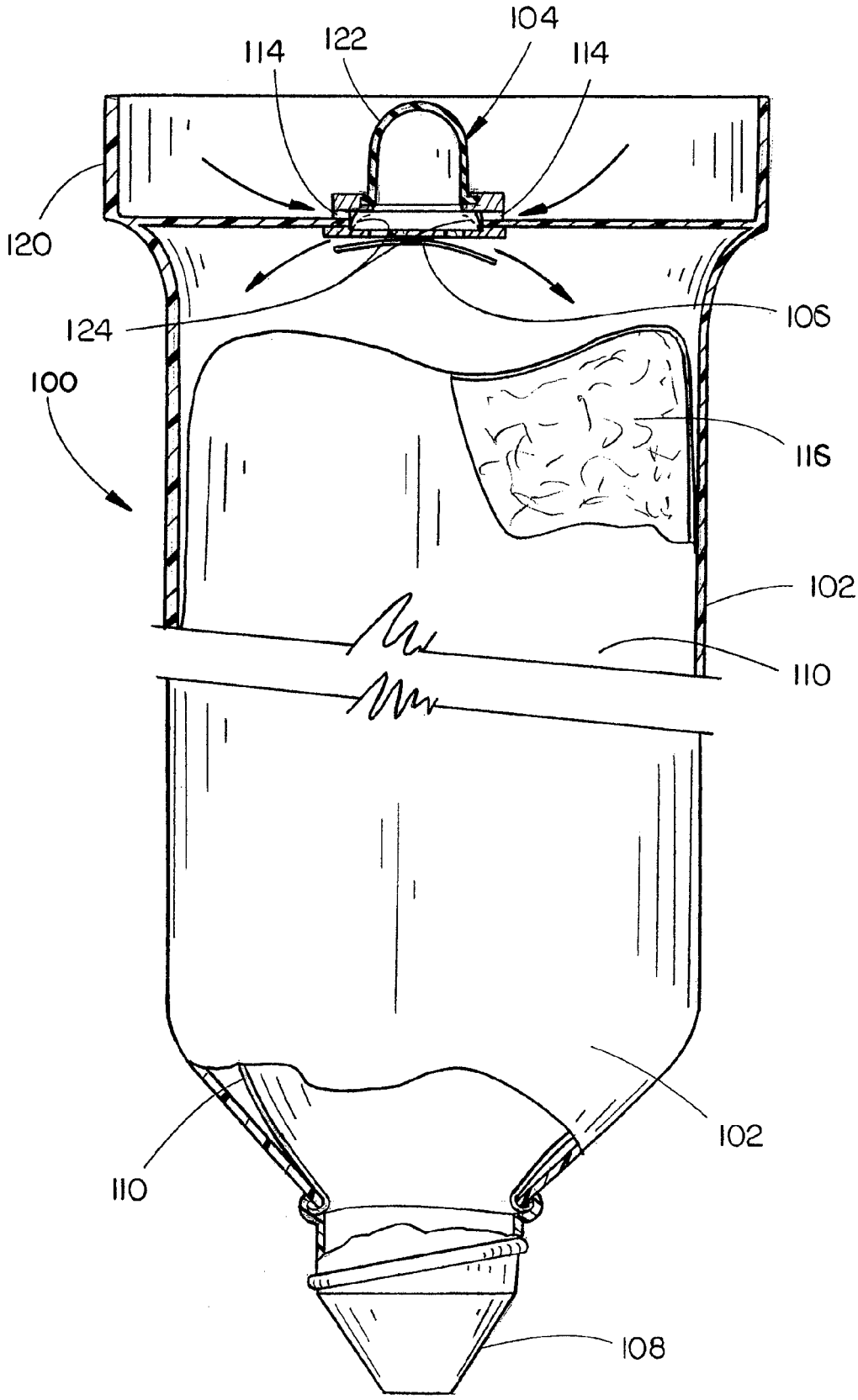
FIG. 2 is a cross-sectional side view of the food dispensing apparatus illustrated in FIG. 1, wherein a portion of the outer shell and inner shell has been cut away to illustrate the inner shell, food component, and air pump.
Figure 3:
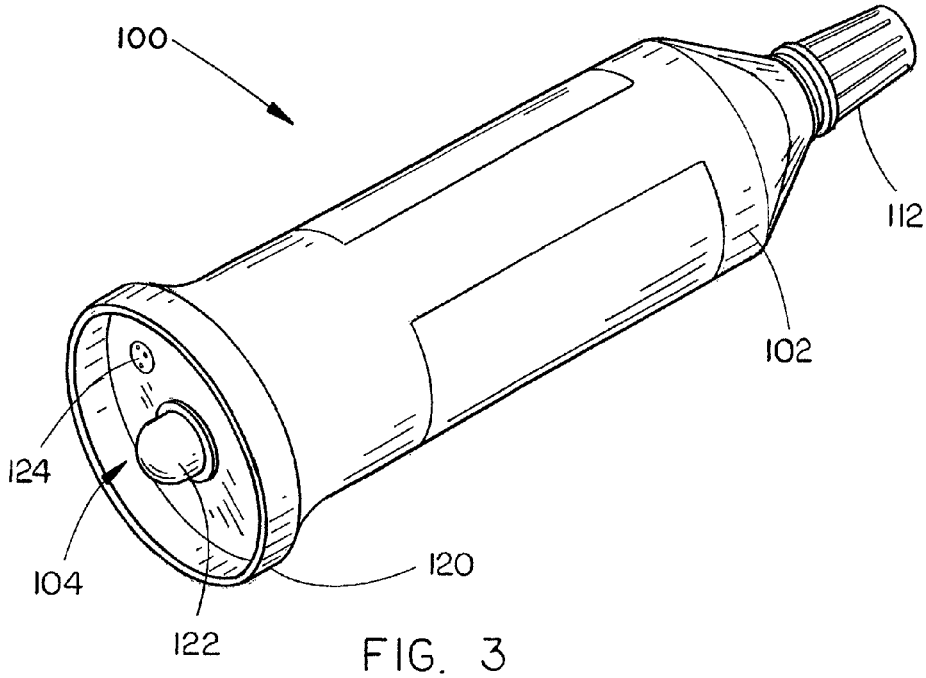
FIG. 3 is an isometric view of the food dispensing apparatus illustrated in FIG. 1.
Figure 4:
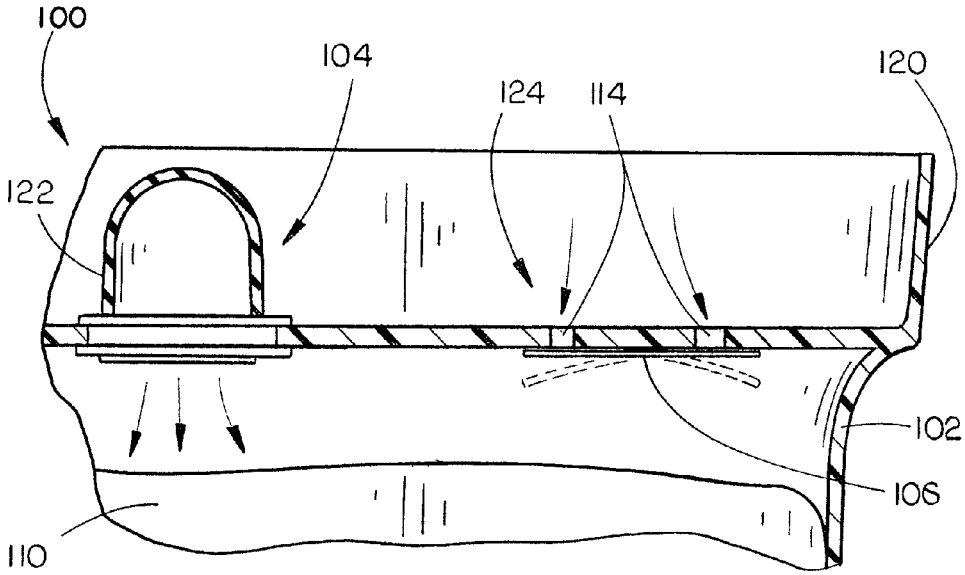
FIG. 4 is partial cross-sectional side view illustrating an air pump assembly and a check valve.
Figure 5:
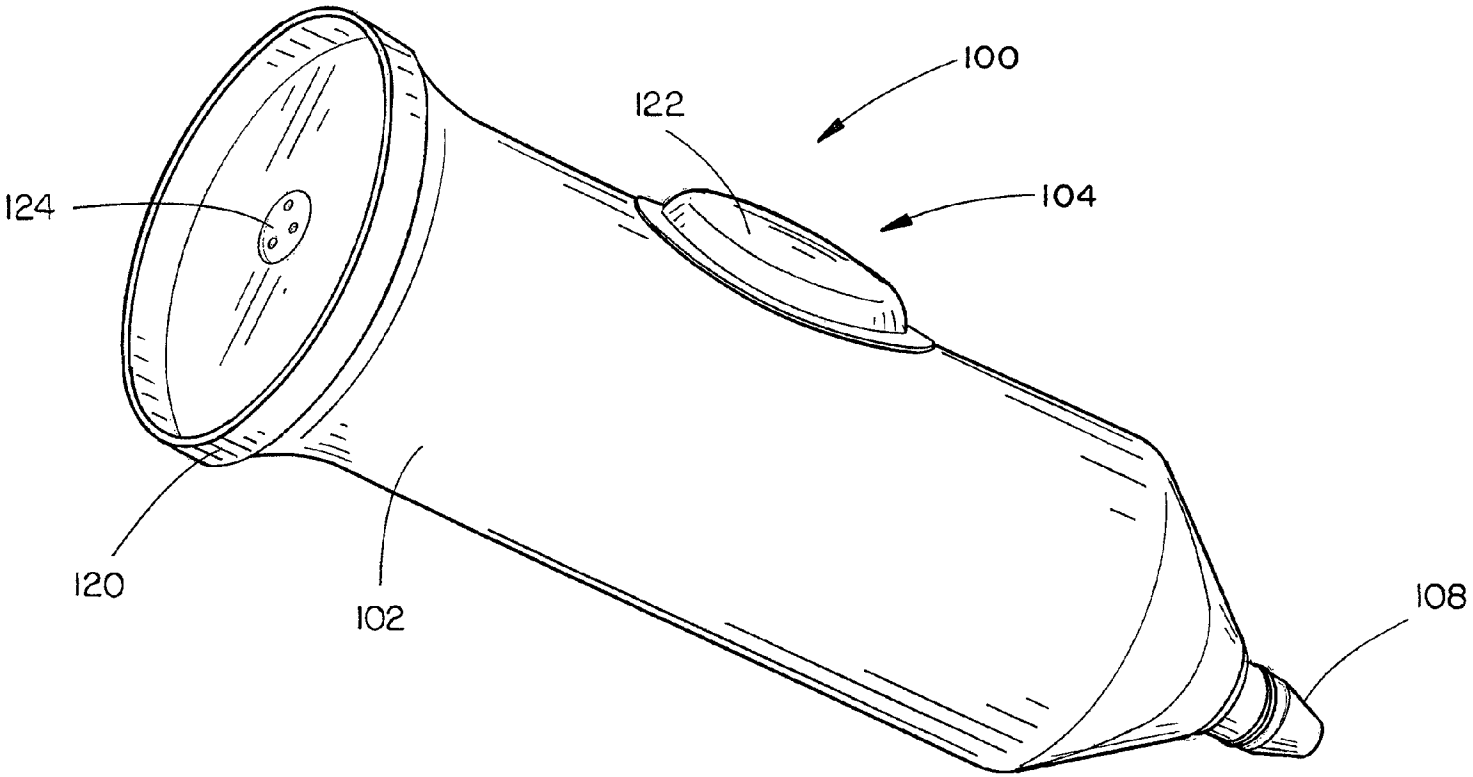
FIG. 5 is an isometric view illustrating a food dispensing apparatus with a side air pump assembly.

The outer shell 102 can comprise an air pump assembly 104 for pumping air into the chamber between the outer shell 102 and the inner shell 110. The additional air in the chamber between the outer shell 102 and the inner shell 110 creates a higher pressure and can dispense or decrease the amount of force necessary to dispense a food component 116 from inside the inner shell 110 through the nozzle 108. The air pump assembly 104 can be located anywhere on the outer shell 102. The air pump assembly 104 can be located on the base 120, as illustrated in FIGS. 1 and 2. As illustrated in FIG. 5, an air pump assembly 104 can be located on a side of the outer shell 102. The various arrangements can offer different advantages, such as better grip, ease of use, ease of production, and lower costs.

The air pump assembly 104 can comprise one or more air conduits 114 and a resilient valve 106 acting as a barrier. The air conduits 114 allow air to flow through the outer shell 102 and into the chamber between the outer shell 102 and the inner shell 110. The resilient valve 106 can be located adjacent to and covering the air conduits 114 on the inner surface of the outer shell 102. The resilient valve 106 and the air conduits 114 can combine to form an air vent 124. The air vent 124 allows the air to flow one-way into the chamber between the outer shell 102 and the inner shell 110 when the pressure outside of the outer shell 102 is greater than the pressure inside the outer shell 102. The air vent 124 can be a one-way valve 118*b* of a check valve assembly 118 described in detail below. When air pressure in the chamber between the outer shell 102 and the inner shell 110 is greater than the pressure of the atmosphere outside of the food dispensing apparatus 100, the resilient valve 106 prevents air from leaving the chamber through the air conduits 114.

The air pump assembly 104 can further comprise a bulb reservoir 122. The bulb reservoir 122 comprises an air vent 124. The bulb reservoir can be located adjacent to one or more additional and separate air vents 124 comprising the air conduits 114 and the resilient valve 106. The bulb reservoir 122 pumps a predetermined volume of air into the chamber between the outer shell 102 and the inner shell 110. The bulb reservoir 122 can be depressed forcing the predetermined volume of air contained in the bulb reservoir 122 through the air vent 124. The bulb reservoir 122 can be located anywhere on the outer shell 102 including the base 120. One or more additional air vents 124 can allow the bulb reservoir 122 to refill with air as the bulb reservoir 122 returns to the bulb reservoir's original shape subsequent to being depressed for pumping air.

Alternatively, the air pump assembly 104 can include other means for supplying air or another gas to the chamber between the outer shell 102 and the inner shell 110 to create pressure. The gas can be a pressurized gas. The pressurize gas can be carbon dioxide, nitrogen, and/or nitrous oxide. This list is not restrictive. It is understood that any pressurized gas suitable for a food dispensing apparatus 100 can be utilized without departing from the scope and intent of the disclosure. A gas, such as carbon dioxide, can be supplied by a cartridge to increase the pressure on the inner shell 110. It is contemplated that any air pump assembly suitable for supplying air into the chamber between the first shell and the second shell can be utilized without departing from the scope and intent of the disclosure.

Located within the outer shell 102 is the inner shell 110 for containing a food component 116. Multiple inner shells 110 can be located in the outer shell 102. The multiple inner shells 110 can be suitable for holding multiple and/or different food components 116. The inner shell 110 is comprised of collapsible and/or flexible material. The inner shell 110 can be composed of a metal foil, such as aluminum foil, a polymer, a polymer blend, and/or mixtures thereof. This list is not restrictive. It is understood that other materials with the necessary flexibility, tensile strength, and collapsibility suitable for containing food components can be utilized without departing from the scope and intent of the disclosure.

The inner shell 110 can be sealed or connected to the outer shell 102. The outer shell 102 is coupled to a nozzle 108. The inner shell 110 is coupled to the nozzle 108. The inner shell 110 can be coupled to the valve of the nozzle 108. The nozzle 108 can form an air tight or substantially air tight seal to the inner shell 110 and/or the outer shell 102. The valve of the nozzle 108 can form the air tight or substantially air tight seal to the inner shell 110. The nozzle 108 can form a leak-proof or leak-resistant seal with the inner shell 110 comprising a food component 116.

The means for coupling the nozzle 108 to the outer shell 102 and/or the inner shell 110 can comprise heat and/or pressure sealing a lip or surface area. The inner shell 110 can be placed between the nozzle 108 and the outer shell 102 and sealed for the leak-proof or leak-resistant and/or air tight or substantially air tight connection. The nozzle 108 can comprise a gasket arrangement in which a gasket provides a seal between the inner shell 110 and the nozzle 108. It is appreciated that other methods can be used to situate the inner shell 110 and the outer shell 102 with the nozzle 108 and the valve to form a leak-proof or leak-resistant and/or air tight or substantially air tight seal without departing from the scope and intent of the disclosure.

Figure 18:
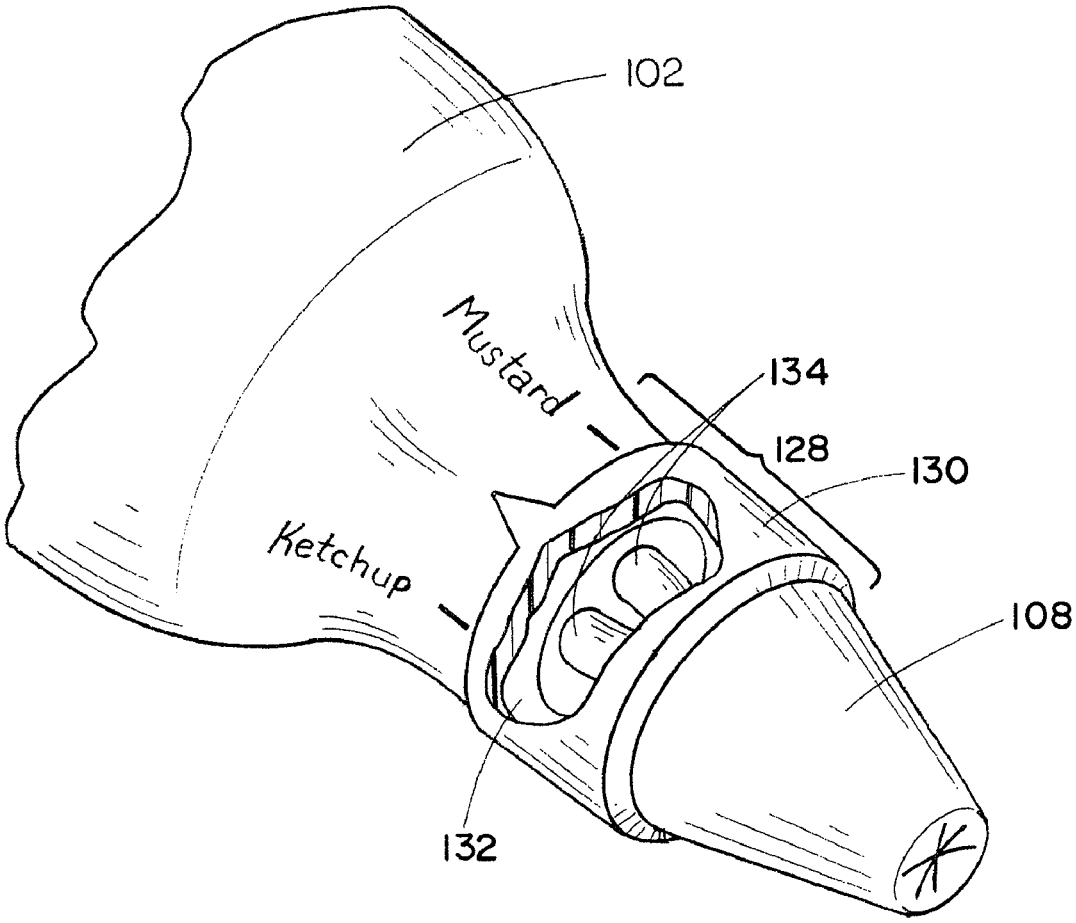
FIG. 18 is a partial isometric view illustrating a food dispensing apparatus, wherein a cutaway view of a selecting valve shows a selecting valve plate.

The outer shell 102 may contain multiple inner shells 110, as illustrated in FIG. 15. A valve selector assembly 128 can be coupled with the nozzle 108 and/or the outer shell 102, as illustrated in FIGS. 14 through 18. The valve selector assembly 128 is coupled to the multiple inner shells 110. Each inner shell 110 may comprise a food component 116, which is kept separate from the food component 110 contained in another inner shell 110. The inner shells 110 may contain different food components 116. The valve selector assembly 128 is suitable for allowing the consumer to choose one of multiple and/or different food components 116 contained in the multiple inner shells 110 of the food dispensing apparatus 100. The valve selector assembly 128 can also be suitable for allowing food components 116 of different shells to be dispensed at one time, as shown in FIG. 18.

The valve selector assembly can comprise a selecting plate 132, at least one selecting valve 130, at least one selecting valve orifice 134, and at least two inner shell orifices, as illustrated in FIG. 18. The selecting plate 132 can be movably coupled to the nozzle 108. The at least one selecting valve orifice 134 can extend through the selecting plate 132. The at least one selecting valve 130 can be coupled to the at least one selecting valve orifice 134. The at least two inner shell orifices can be coupled to the at least two inner shells 110 and adjacent to the selecting plate 132. The selecting plate 132 is operatively movable to align the at least one selecting valve orifice 134 with at least one of the at least two inner shell orifices. The selecting valve 130, the selecting plate 132, the selecting valve orifice 134 are suitable for allowing food to pass from an inner shell 110 via the inner shell orifice. The valve selector assembly 128 may be positioned so that the selecting valve orifice 134 allows food components 116 from more than one inner shell 110 to pass through the selecting valve 130 and nozzle 108 simultaneously. The simultaneous dispensing of at least two food components by the valve selector assembly can be suitable for mixing the food components 116 together. It is understood that any suitable valve selector assembly for selecting at least one inner shell out of multiple inner shells may be utilized without departing from the scope and intent of the disclosure.

The nozzle 108 provides the means for the food component 116 to pass from the inner shell 110 onto the desired object. The nozzle 108 can comprise a valve. The nozzle 108 can comprise a check valve 126. The check valve 126 comprises a one-way valve, such as a flap valve, ball valve, spring valve, or any other known one-way valves suitable for utilization with a food component. The check valve 126 allows the food component 116 to exit the inner shell 110 while preventing air or other foreign material from entering the inner shell 110. The check valve 126 can also prevent air from leaving the chamber between the at least one inner shell and the outer shell and from leaving a bulb reservoir. The check valve 126 can be part of a check valve assembly 118. The check valve assembly 118 comprises two or more one-way valves that open or close as designed in response to a common force or pressure. The nozzle 108 can comprise a first one-way valve 118*a*. The check valve 126 located in the nozzle 108 helps to prevent separation by preventing air from entering the inner shell 110 through the nozzle 108 during food dispersal. Because the check valve 126 helps to prevent air from entering the inner shell 110, the formation of headspace or an air pocket is avoided, this in turn prevents serum separation because there is no space for the formation of the serum. Additionally, the food dispensing apparatus 100 prevents oxidation and sugar carmelization by preventing air from entering the at least two inner shells and contacting the food component 116 to help maintain or increase shelf life and/or to help maintain flavor, taste, and consistency of the food component 116. Further, the food dispensing apparatus prevents the food component 116 located in the inner shell 110 from drying out or being exposed to foreign material to increase and/or maintain the shelf life and to maintain a desired taste, flavor, and consistency of the food component 116. Further, the check valve or the valve selector assembly 128 included in the nozzle 108 may help to prevent air or other foreign materials from entering the dispensing nozzle 108 and inner shells 110.

Referring generally to FIGS. 13A, 13B, 3C, and 13D a food dispensing apparatus 100 dispensed by consumer compression comprising a check valve assembly with two one-way valves and a food component 116 within the inner shell 110 is shown in various states. The states represent the different physical transformations undergone by the food dispensing apparatus 100 to dispense the food component 116 and the inter-workings of the two one-way valves.

Figure 13A:
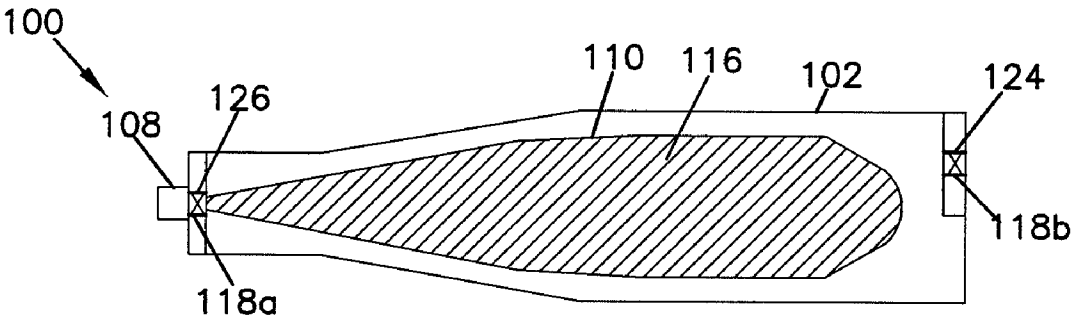
FIG. 13A is a cross sectional side view schematic diagram illustrating a food dispensing apparatus, wherein the food dispensing apparatus shows a closed check valve and a closed air vent.

Referring to FIG. 13A, the food dispensing apparatus 100 is shown in an equalized state or a state where the food dispensing apparatus 100 has a pressure substantially equal to the atmosphere outside of the food dispensing apparatus 100. All one-way valves of the check valve assembly 118 remain closed in this state. The first one-way valve 118*a* or the one valve labeled 126 is located in the nozzle 108.

The second one-way valve 118*b* or the air vent labeled 124 is located in the base 120. The second one-way valve 118*b* can be positioned anywhere on the outer shell 102. The first one-way valve 118*a* helps prevent air from entering the second shell. The second one-way valve 118*b* prevents air from leaving the chamber between the first shell 102 and the second shell 110.

Figure 13B:
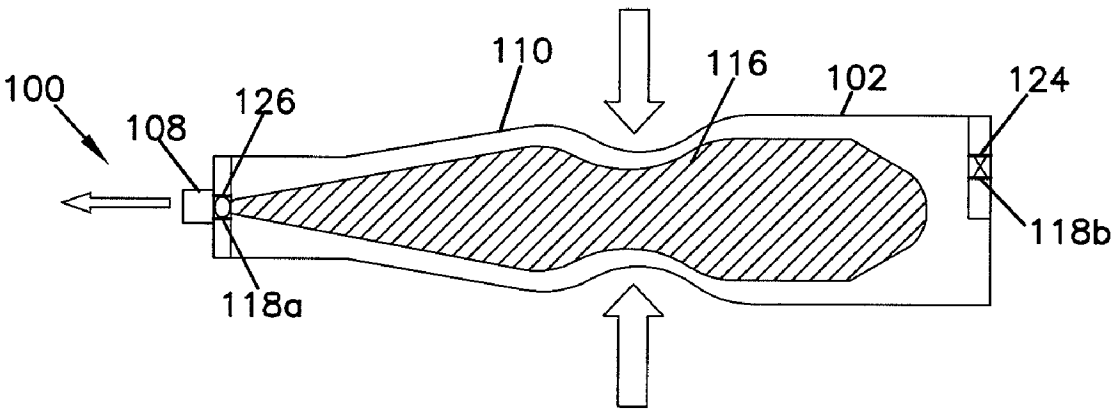
FIG. 13B is a cross sectional side view schematic diagram illustrating a food dispensing apparatus, wherein the food dispensing apparatus shows an open check valve and a closed air vent.

Referring to FIG. 13B, a food dispensing apparatus 100 in a squeezed state or state where the pressure inside the food dispensing apparatus 100 is substantially greater than the atmosphere outside of the food dispensing apparatus 100 is shown. A squeeze state happens when the consumer squeezes the food dispensing apparatus to expel the food component 116. In the squeezed stated, the second one-way valve 118*b* remains tightly closed to prevent the air in the chamber from escaping, while the first one-way valve 118*a* opens allowing the food component to dispense from the inner shell 110.

Figure 13C:
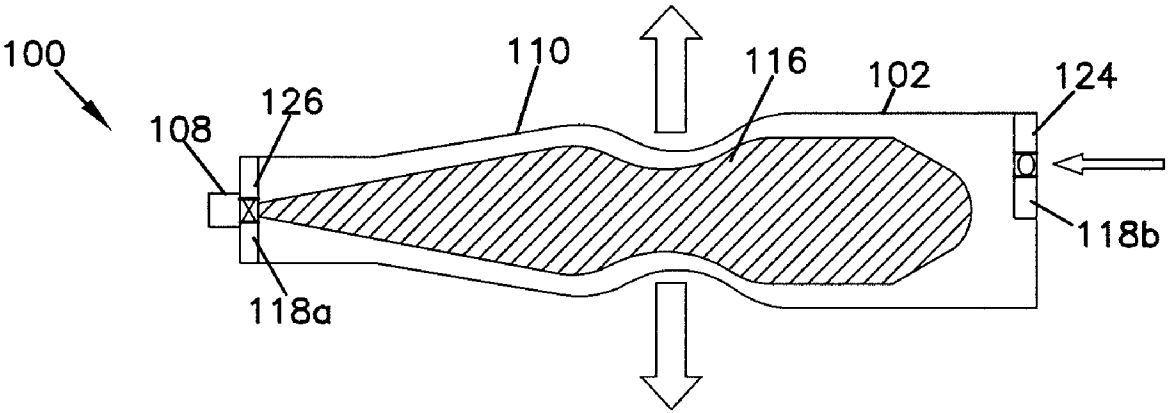
FIG. 13C is a cross sectional side view schematic diagram illustrating a food dispensing apparatus, wherein the food dispensing apparatus shows a closed check valve and an open air vent.
Figure 13D:
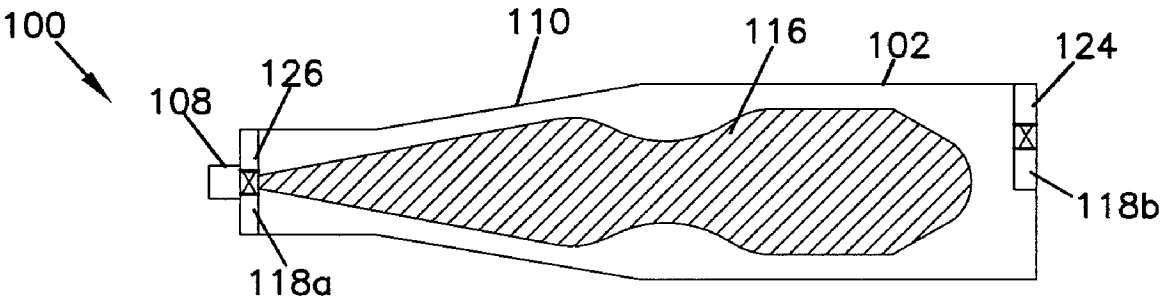
FIG. 13D is a cross sectional side view schematic diagram illustrating a food dispensing apparatus, wherein the food dispensing apparatus shows a closed check valve, a closed air vent, and a partially collapsed inner shell.
Figure 14:
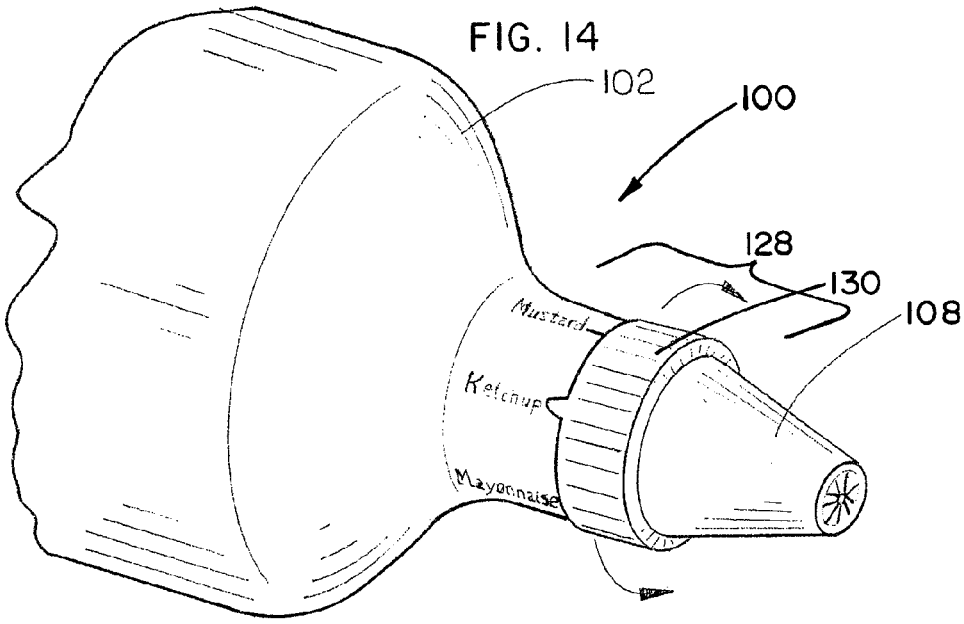
FIG. 14 is a partial isometric view illustrating a food dispensing apparatus, wherein a selecting valve is shown as part of the dispensing nozzle.

Referring to FIG. 13C, the squeeze bottle in a released state or a state where the pressure inside the food dispensing apparatus 100 is substantially less than the pressure of the atmosphere surrounding the food dispensing apparatus 100 is shown. A release state can be produced after the consumer releases the food dispensing apparatus 100 directly after squeezing the food dispensing apparatus 100. During the release state, the first one-way valve 118*a* closes and prevents air from entering the inner shell and prevents the dispersion of the food component 116. The second one-way valve 118*b* opens during the release state allowing air to enter the chamber between the inner shell 110 and the outer shell 102. No air or substantially no air is allowed to leave the chamber through the second one-way valve 118*b* during the release state. The second one-way valve 118*b* will allow air to enter into the chamber between the first shell 102 and second shell 110 until the pressure in the food dispensing apparatus 100 is substantially the same as the pressure of the atmosphere outside of the food dispensing apparatus 100 reverting the food dispensing apparatus 100 to the equalized state, as illustrated in FIG. 13D. Therefore, the second one-way valve 118*b* allows the outer shell to return to the outer shell's original shape without requiring the inner shell to return to the inner shell's original shape, as shown in FIG. 13D.

The utilization of a check valve assembly with two one-way valves helps prevent air from entering the inner shell 110 and prevents a headspace from forming and thereby helps to prevent the formation of serum on the food component 116. The food dispensing apparatus 100 comprising a check valve assembly with two one-way valves can further comprise an air pump assembly 104 for reducing the amount of force required by a consumer to dispense the food component 116. Further, a one-way valve utilized in the air pump assembly 104 or a selector valve can be a third one-way valve of the check valve assembly.

The nozzle 108 can be fitted with a lid 112. The lid 112 can further protect the food component 116. The lid 112 can be coupled and/or attached to the nozzle 108, the outer shell 102, and/or the base 120. The lid 112 can be separate and removed from the nozzle 108, the outer shell 102, and/or the base 120. The lid 112 can have any suitable lid closing mechanism, such as a snap on/off, twist on/off, push on and pull off, or push on and twist off mechanism. This list is not restrictive. Any suitable lid designed for a food dispensing apparatus can be utilized without departing from the scope and intent of the disclosure.

The food dispensing apparatus 100 can comprise a collapsible filling conduit 156. The collapsible filling conduit 156 provides a path from a filling check valve 158 located in the outer shell to the inner shell 110. The food dispensing apparatus 100 can be refillable. The collapsible filling conduit 156 can be utilized for filling or refilling the food dispensing apparatus 100. A food filling apparatus 152 can be utilized for filling a food dispensing apparatus 100 or a refillable food dispensing apparatus 100. The food filling apparatus 152 can be any suitable food filler with a food filling nozzle suitable for insertion into the filling check valve 158 coupled to the collapsible filling conduit 156 of the food dispensing apparatus 100. The food filling apparatus 152 includes a food filling nozzle 154. The food filling nozzle 154 is inserted into the collapsible filling conduit 156 through the filling check valve 158. The collapsible filling conduit 156 provides means for inserting a food component 116 from the food filling nozzle 154 to the inner shell 110 of the food dispensing apparatus 100. The filling check valve 158 is a one-way valve that prevents the food component 116 from exiting the inner shell 110 and the collapsible filling conduit 156. The filling check valve 158 can also prevent air form entering the inner shell 110 with the insertion of the food component 116 thereby helping to prevent the formation of serum. As the food component 116 is transported through the collapsible filling conduit 156, the food component 116 fills the inner shell 110, and the inner shell 110 expands. The food component 116 can fill a portion of the inner shell 110, fill the inner shell 110 completely, or fill the inner shell 110 until the volume inside the outer shell 102 is substantially filled by the inner shell 110.

After filling, a consumer can dispense the food component from the food dispensing apparatus 100. As the food component 116 is dispensed, the inner shell 110 collapses. As soon as the inner shell 110 collapses to any degree, the inner shell 110 can be filled again by the food filling apparatus 152 with additional food component 116 as described above.

The food dispensing apparatus 100 suitable for dispensing multiple food components 100 can also be refilled and reusable. Each inner shell 110 will be coupled to a separate collapsible filling conduit 156 and filling check valve 158.

A method for preventing serum separation while storing a food component comprises placing a second shell inside a first shell, placing a food component in a the second shell, and coupling a nozzle to the first shell and/or the second shell, the nozzle comprising a check valve, wherein the check valve helps to prevents air from entering the second shell and the food dispensing apparatus substantially prevents serum separation in the food component.

A method for dispensing multiple food components 116 from a food dispensing apparatus 100 comprises placing food in an inner shell 110, placing the inner shell in an outer shell 102, coupling a nozzle 108 to the outer shell 102 for providing a dispensing nozzle, fastening the inner shell to the outer shell, utilizing a food selector located in the nozzle to choose at least one of multiple food components, supplying air to the chamber between the outer shell and the at least one inner shell for creating superatmospheric pressure within the food dispensing apparatus 100 for dispensing the selected food components 116 from the food dispensing apparatus 100.

It is believed that the disclosure and many of its attendant advantages will be understood by the foregoing description, and it will be apparent that various changes can be made in the form, construction and arrangement of the components thereof without departing from the scope and spirit of the disclosure or without sacrificing all of its material advantages. The form herein before described being merely explanatory thereof, it is the intention of the following claims to encompass and include such changes.

What is claimed is:

1. A food dispensing apparatus, comprising:

a first shell having a first end and a second end, the second end located generally opposite the first end and forming a base of the food dispensing apparatus;

at least one second shell disposed within the first shell;

a nozzle coupled to the first end of the first shell and the at least one second shell;

a check valve disposed in the nozzle coupled to the at least one second shell, wherein the at least one second shell is suitable for containing a food component; and an air pump assembly disposed on the base of the first shell, the air pump assembly configured for pumping air into a chamber between the first shell and the at least one second shell to cause pressure on the at least one second shell to thereby apply pressure to the food component contained in the at least one second shell for dispensing the food component through the nozzle, the air pump assembly including a bulb reservoir, the bulb reservoir being located on the base of the food dispensing apparatus, the bulb reservoir being disposed over an air conduit formed in the base, the bulb reservoir configured for being depressible for pumping the air into the chamber via the air conduit, wherein the food dispensing apparatus is suitable for preventing air from entering the at least one second shell.

2. The food dispensing apparatus of claim 1, wherein the food dispensing apparatus prevents serum separation.

3. The food dispensing apparatus of claim 2, further comprising an air vent disposed in the first shell, the air vent including a one-way valve.

4. The food dispensing apparatus of claim 1, further comprising an air vent disposed in the first shell, the air vent including a one-way valve.

5. The food dispensing container of claim 1, wherein the bulb reservoir comprises a one-way valve.

6. The food dispensing apparatus in claim 1, wherein the food dispensing apparatus dispenses the food component without a squeezing force.

7. The food dispensing apparatus of claim 2, further comprising a filling check valve, the filling check valve located in the first shell; and a collapsible filling conduit, the collapsible filling conduit is coupled to the filling check valve and the at least one second shell, wherein the collapsible filling conduit provides a path for insertion of the food component into the at least one inner shell.

8. The food dispensing apparatus of claim 7, wherein the food dispensing apparatus is refillable.

9. The food dispensing apparatus of claim 2, further comprising at least two second shells; and a valve selector assembly, the valve selector assembly located in the nozzle, wherein the valve selector assembly is suitable for selecting the food component contained in one of the at least two second shells.

10. The food dispensing apparatus of claim 9, further comprising at least two filling check valves, the at least two filling check valves located in the first shell; and at least two collapsible filling conduits, each of the at least two collapsible filling conduits is coupled to one of the at least two filling check valves and to one of the at least two second shells, wherein the at least two collapsible filling conduits provide a path for insertion of the food component in to each of the at least two inner shells.

11. The food dispensing apparatus of claim 9, wherein the valve selector assembly further comprises, a selecting plate, the selecting plate movably coupled to the nozzle;

at least one selecting valve orifice, the at least one selecting valve orifice extending through the selecting plate;

at least one selecting valve, the at least one selecting valve coupled to the at least one selecting valve orifice; and at least two inner shell orifices, the at least two inner shell orifices coupled to the at least two inner shells and adjacent to the selecting plate, wherein the selecting plate is operatively movable to align the at least one selecting valve orifice with at least one of the at least two inner shell orifices.

12. The food dispensing apparatus of claim 11, wherein the at least one selecting valve is a one-way valve.

13. The food dispensing apparatus of claim 11, wherein the selecting plate is operatively movable to align two of the at least one selecting valve orifices with the two of the at least two inner shell orifices for dispensing the food component from two of the at least two inner shells.

14. A food dispensing apparatus, comprising:

a first shell having a first end and a second end, the second end located generally opposite the first end and forming a base of the food dispensing apparatus;

at least one second shell disposed within the first shell;

a nozzle coupled to the first end of the first shell and the at least one second shell; and an air pump assembly disposed on the base of the first shell, the air pump assembly configured for pumping air into a chamber between the first shell and the at least one second shell to cause pressure on the at least one second shell to thereby apply pressure to a food component contained in the at least one second shell for dispensing the food component through the nozzle, the air pump assembly including a bulb reservoir, the bulb reservoir being located on the base of the food dispensing apparatus, the bulb reservoir being disposed over an air conduit formed in the base, the bulb reservoir configured for being depressible for pumping the air into the chamber via the air conduit, wherein the food dispensing apparatus is suitable for preventing air from entering the at least one second shell.

15. The food dispensing apparatus in claim 14, wherein the food dispensing apparatus dispenses the food component without a squeezing force.

16. The food dispensing container in claim 14, wherein the air pump assembly comprises a one-way valve.

17. The food dispensing apparatus of claim 14, further comprising a filling check valve, the filling check valve located in the first shell; and a collapsible filling conduit, the collapsible filling conduit is coupled to the filling check valve and the at least one second shell, wherein the collapsible filling conduit provides a path for insertion of the food component into the at least one inner shell.

18. The food dispensing apparatus of claim 17, wherein the food dispensing apparatus is refillable.

19. The food dispensing apparatus of claim 14, further comprising:

at least two second shells; and a valve selector assembly, the valve selector assembly located in the nozzle, wherein the valve selector assembly is suitable for selecting the food component from one of the at least two second shells.

20. The food dispensing apparatus of claim 19, wherein the valve selector assembly further comprises, a selecting plate, the selecting plate movably coupled to the nozzle;

at least one selecting valve orifice, the at least one selecting valve orifice extending through the selecting plate;

at least one selecting valve, the at least one selecting valve coupled to the at least one selecting valve orifice; and at least two inner shell orifices, the at least two inner shell orifices coupled to the at least two inner shells and adjacent to the selecting plate, wherein the selecting plate is operatively movable to align the at least one selecting valve orifice with at least one of the at least two inner shell orifices.

21. The food dispensing apparatus of claim 20, wherein the selecting plate is operatively movable to align two of the at least one selecting valve orifices with the two of the at least two inner shell orifices for dispensing the food component from two of the at least two inner shells.

22. A food product, comprising:

a food dispensing apparatus, the food dispensing apparatus comprising:

a first shell having a first end and a second end, the second end located generally opposite the first end and forming a base of the food dispensing apparatus;

at least one second shell disposed within the first shell;

a nozzle coupled to the first end of the first shell and the at least one second shell;

a check valve disposed in the nozzle coupled to the at least one second shell; and an air pump assembly disposed on the base of the first shell, the air pump assembly configured for pumping air into a chamber between the first shell and the at least one second shell to cause pressure on the at least one second shell to thereby apply pressure to the food component contained in the at least one second shell for dispensing the food component through the nozzle, the air pump assembly including a bulb reservoir, the bulb reservoir being located on the base of the food dispensing apparatus, the bulb reservoir being disposed over an air conduit formed in the base, the bulb reservoir configured for being depressible for pumping the air into the chamber via the air conduit; and a food component disposed in the at least one second shell of the food dispensing apparatus, the food component comprising any liquid or semi-solid food component capable of undergoing serum separation;

wherein the food dispensing apparatus is suitable for preventing air from entering the at least one second shell and prevents serum separation.

23. The food product of claim 22, wherein food component is selected from a group of ketchup, tomato paste, tomato sauce, mustard, and pizza sauce.

* * * * *